United States Patent [19]

Catlett

[11] 4,333,270

[45] Jun. 8, 1982

[54] AUTOMATIC DOOR OPERATOR

[75] Inventor: John C. Catlett, Cordova, Tenn.

[73] Assignee: BESAM-EADS, Inc., Memphis, Tenn.

[21] Appl. No.: 123,503

[22] Filed: Feb. 22, 1980

[51] Int. Cl.[3] ..... E05F 15/12

[52] U.S. Cl. ..... 49/336

[58] Field of Search ..... 49/30, 266, 264, 273, 49/334, 336

[56] References Cited

U.S. PATENT DOCUMENTS 3,087,720 4/1963 Catlett ..... 49/336 X 3,237,932 3/1966 Catlett ..... 49/334 X

FOREIGN PATENT DOCUMENTS 2020734 11/1979 United Kingdom ..... 49/336

*Primary Examiner*—Kenneth Downey

*Attorney, Agent, or Firm*—Kalish & Gilster

[57] ABSTRACT

A door operator of electromechanical character for utilization with swing-mounted doors is provided in a self-contained unit for mounting as a part of a door frame or for attachment to existing doors and frames. The opener has a door driving shaft mounted for rotation about a vertical axis and connectable to a door for closing and opening of the door when rotated, and a transmission interconnecting a prime mover and door driving shaft for rotation to open the door upon selective delivery of power by the prime mover. A pinion interconnected with the shaft meshes with a rack gear for shifting of the rack gear about a longitudinal axis in response to rotation of the shaft. The unit includes a module of interchangeable character having a preloaded spring and configured for the intended direction(s) of rotation of the door for opening. The spring receives energy from the rack gear upon door opening and then transfers the stored energy to the rack gear upon cessation of delivery of power by the prime mover for producing rotation of the shaft in the opposite direction to close the door while returning power to the prime mover, which is preferably an electronically driven and controlled d.c. motor. The rack gear and spring module permit rotation of the shaft also in a direction for emergency opening of the door.

8 Claims, 13 Drawing Figures

AUTOMATIC DOOR OPERATOR

BACKGROUND AND SUMMARY OF THE INVENTION

This invention relates in general to door operating devices and, more particularly, to an electronically actuated door operator incorporating certain new and useful improvements for controlling door opening in both normal and emergency directions.

The present invention constitutes an improvement of Catlett U.S. Pat. No. 4,045,914, entitled Automatic Door Operator. The operator disclosed therein is the type having an electrical prime mover and gear train for driving a door open by means of a driving shaft, there being a spiral leaf spring surrounding the driving shaft which is wound for storing energy during door opening operation. The operator is configured to provide for normal opening of the door in a single given direction rather than being of an interchangeable character for installations requiring the swinging of a door for normal opening in an opposite direction or for both directions. Accordingly, such operator is manufactured for a given type of door installation rather than being of a universal character.

It is an object of the present invention to provide a door operator of the present invention which is of an interchangeable, universal character for providing for automatic opening of doors which are not only intended for either left hand or right hand swing but also for both left and right hand swing.

It is an object of the present invention to provide a door operator of electromechanical character which is uniquely adapted for utilization with various types of doors of the swing-mounted type, such as center pivot, butt hinge, or offset pivot mounting.

It is another object of the present invention to provide a door operator of the character stated which is automatic in operation, being markedly compact.

It is a further object of the invention to provide a door operator of the character stated which can be either mounted within the header portion of a door frame during installation or which may be utilized with existing door constructions without necessitating expensive modification and reconstruction.

It is a still further object of the invention to provide an automatic door operator of the character stated which provides not only normal automatic opening of a door but also readily and safely permits emergency or so-called panic opening of the door.

It is a further object of the present invention to provide an automatic door operator of the character stated including a motion transmission system allowing door movement during panic opening without interference with a prime mover of the system, and which also provides automatic disabling of the prime mover in the event the door is opened under panic conditions.

It is a still further object of the present invention to provide an automatic door operator which can be rapidly configured or reconfigured for providing operation of various types of swing-mounted doors.

It is a still further object of the present invention to provide an automatic door operator of the character stated which permits convenient adjustment of the limits of door movement for both normal and panic opening thereof.

It is a still further object of the present invention to provide an automatic door operator of the type stated which embodies a permanent magnet type of motor adapted to provide dynamic braking action upon door closing consequent to spring developed power for closing the door, and wherein energizing of the motor is not required for closing the door.

It is a further object of the present invention to provide an automatic door operator of the character stated which is most economically manufactured and configured for various types of swing mounted doors, the elements of which operator are designed for quiet, smooth, low friction operation conducting to longevity of unimpaired operation; which is configured to provide extreme duration and reliability of usage; and which is extremely versatile in the door control art in being adapted for activation by any of the various remotely located control devices.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
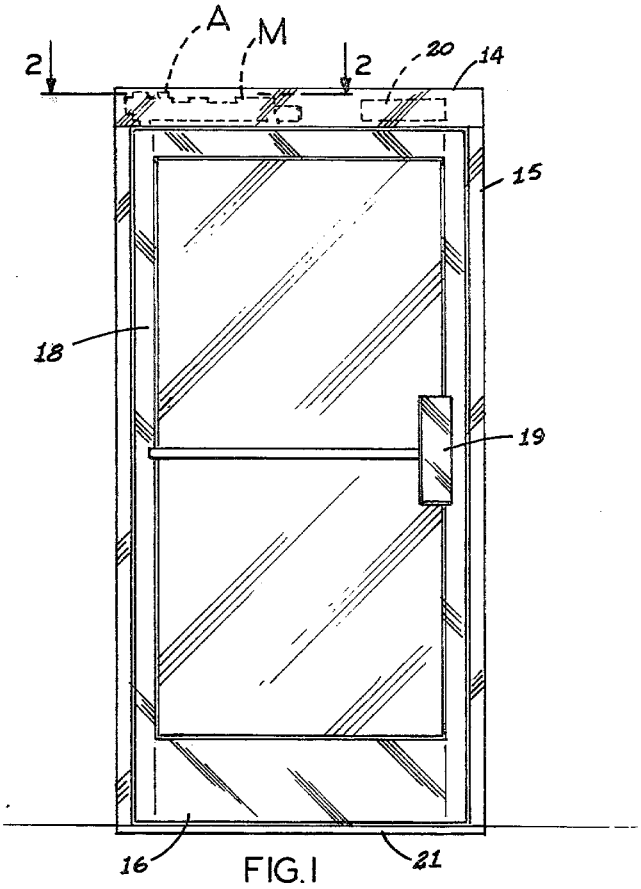
FIG. 1 is a front elevation of a door which is swing mounted in the header of a door frame incorporating a door operator constructed in accordance with and embodying the present invention.

Referring now by reference characters to the drawings which illustrate the preferred embodiments of the present invention, with specific reference to FIGS. 1–4, A generally designates a door operator of the invention. Door operator A is shown, merely for purposes of illustration, as mounted within the header or upper portion 14 of a door frame 15 having a door 16 which is swing mounted for opening about a hinge axis or pivot axis extending vertically through the left edge 18 of the door. The door is provided with a handle 19 of the conventional type but it is understood that in normal usage door 16 is opened automatically by operator A when a control 20 (within header 14) for the operator is actuated by a person or object approaching the door and exerting pressure upon a switch-type floor mat activating device located in front of the door as at 21. Alternatively, various other kinds of activating devices of known configuration can be utilized, such as photoelectric cells, sonic switches, mechanical switching devices, proximity detectors and the like. All such activating or actuating devices are interconnected with the control 20 which may include various relays and other circuitry for controlling power to be supplied to actuator A, as noted hereinbelow.

Figure 2:
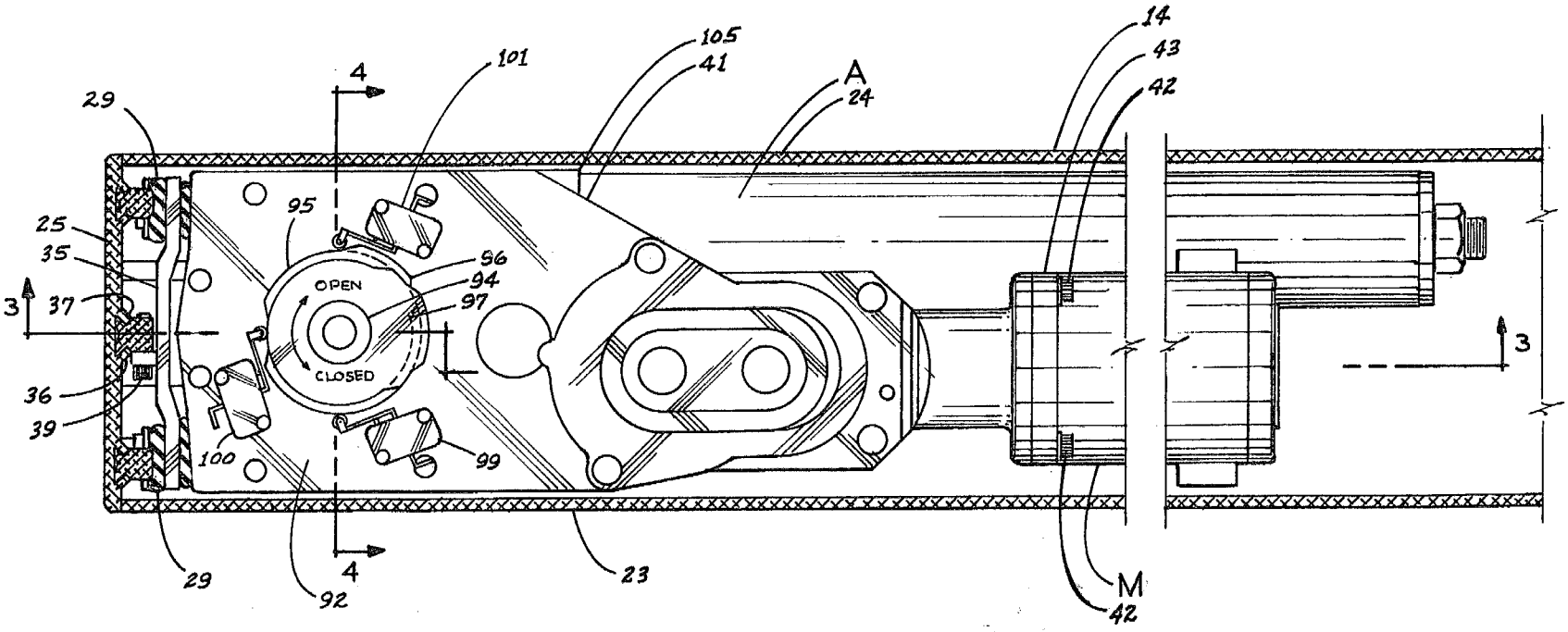
FIG. 2 is a top plan view in partial section of the door header and door operator located therein, as taken generally along line 2—2 of FIG. 1, and illustrating the door operator in operative position.
Figure 3:
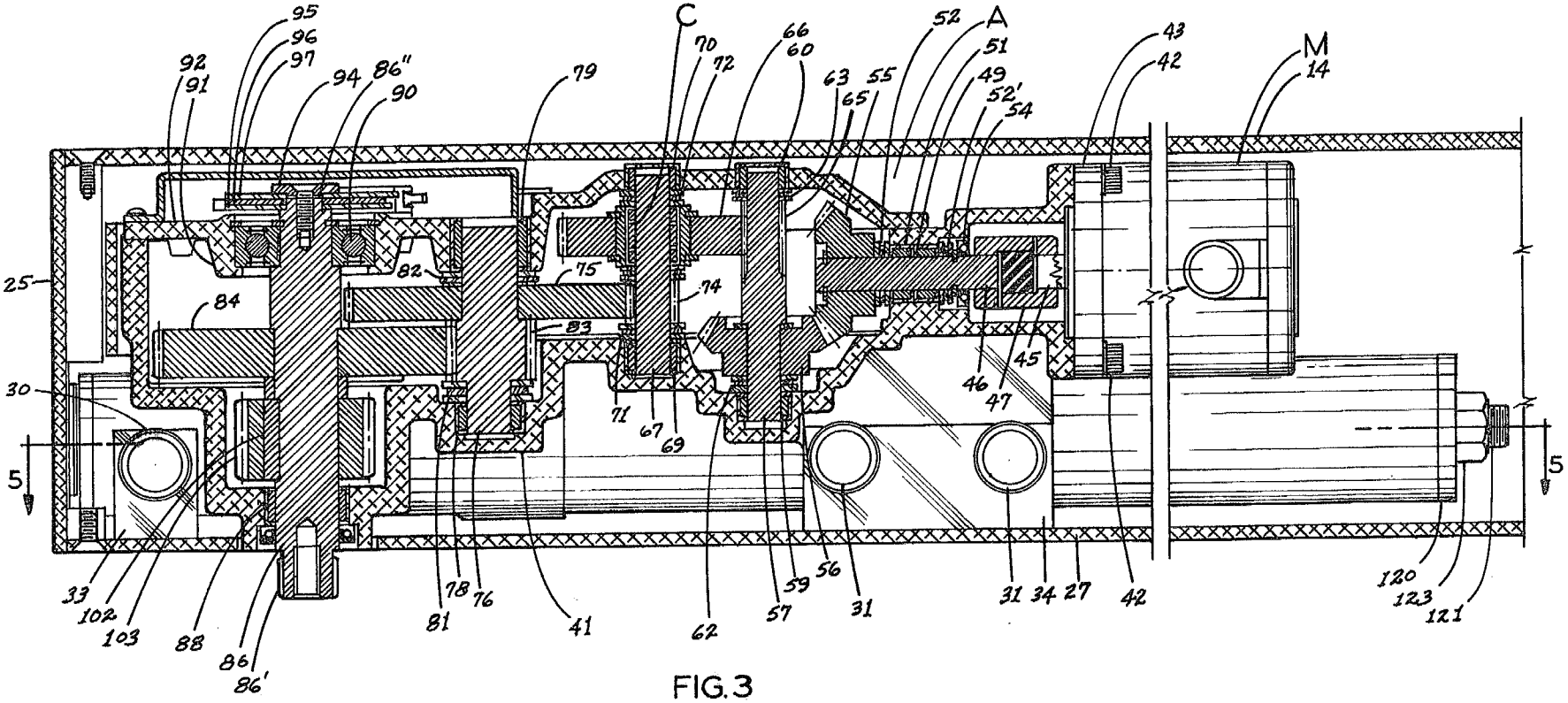
FIG. 3 is a vertical longitudinal sectional view taken along line 3—3 of FIG. 2.

Referring to FIGS. 2 and 3, operator A is provided with a prime mover M constituted by a direct current, shunt wound motor which is of the permanent magnet type providing variable speed of operation in accordance with the extent to which the motor armature is energized by d.c. current.

For such motor, d.c. power can be provided, in response to operation of the switch mat or other activating means, by control 20 having circuitry in accordance with Catlett et al. U.S. Pat. No. 4,006,392 which is herein incorporated by reference. In such a circuit, a.c. power from a conventional source is converted to d.c. power by semiconductor circuitry for being provided to the armature of motor M with a polarity for causing the motor armature rotation for door opening. Further, such a control includes provision for altering the speed of the motor as the door approaches its nearly fully closed and nearly fully opened positions, respectively, as well as provision of reducing energization of motor M in the event of door blockage sensed by the circuitry for precluding damage to the motor from excessive energization. Such control also includes provision for timing certain functions, such as a pre-opening interval and a delay interval during which the door 16 remains open after having been driven open by door operator A.

It is to be understood that door 17 is merely one of various types of doors of the hinged or swing-mounted type which can be operated by operator A, including those which are mounted on center pivots, butt hinges, or offset pivots or hinges. In addition, while operator A is shown to be located within the door frame header 14, it should be understood that the actuator can be provided as a unit within a suitable enclosure intended for being mounted on a surface adjacent an existing door and frame, thus permitting an existing door to be actuated by operator A in the same or functionally equivalent manner as door 16.

In accordance with the present invention, it is to be understood that while operator A is intended for automatically driving door 16 open in response to a person or object, such as a cart, contacting the floor mat switch 21 or other activating means, the new operator is also designed to readily permit door operation in accordance with building code requirements which essentially require than an automatic door for pedestrian traffic be capable of being operated manually in the event of power failure, as well as in panic or emergency situations. Hence, handle 19 is provided whereby the door may be pushed open manually. In such installation, it is typically required that the door automatically open in one direction, the latter being designated normal, yet must be capable of being manually opened in the reverse direction in emergencies or panic situations. Recognizedly, doors are not always hinged or pivoted for normal opening always in the same direction. That is, some doors may require a normal left hand swing opening while permitting right hand swing in the panic mode; or the door may require normal right hand swing with a left hand swing in the panic mode. Further, some doors are intended to provide normally both a right hand swing (left hand panic) and a left hand swing (right hand panic). For purposes of orientation, door 16 if intended for left hand swing (right hand panic) would normally open away from the viewer but under panic conditions would open toward the viewer.

Header 14 in which door operator A is mounted includes a front and rear walls 23,24 and end walls, as at 25, as well as a floor or bottom wall 27, to provide a rectangular enclosure for accommodating the structure of operator A. The header is closed also across the top by a cover 28 or top wall of removable character for providing access to operator A and control wiring, etc.

Operator A is mounted to floor 27 of header 14 by flexible rubber mounts, as at 29, 30 and 31, which are carried by brackets, as at 33, 34 and 35, rigidly secured to floor 27 by screws (not shown). Bracket 35 which extends transversely of header 14 and includes a projection 36 which is secured to a rib 37 carried upon the inner surface of end wall 35, as by a screw 39, thereby to precisely locate the same laterally within the header 14. Each of the flexible mounts 29, 30 and 31 is secured to a transmission housing of the operator, which housing is designated in its entirety at 41, whereby the entire housing 41 is resiliently and flexibly positioned within header 14 in shock absorbing relationship without metal-to-metal contact to prevent vibration, operational noise and shock from being transmitted from the operator A to the header 14 or door frame 15, providing reliability and quietness of operation.

Motor M is in turn secured to one end of housing 41 by screws 42 which extend through a flange 43 of the motor. Referring to FIG. 3, motor M is provided with an output shaft 45 which is connected to a coaxially driven input shaft 46 of the operator by means of a flexible coupling 47. Shaft 46 is journalled within housing 47 by roller needle bearings 49 provided within a bore 51 in housing 41, with there being thrust bearings 52,52' as of wedge roller type on opposite ends of needle bearings 49. A grease seal 54 is located around shaft 46 between thrust bearings 52' and coupling 47.

Affixed to the coupling remote end of shaft 46 is a bevel gear 55 which meshes in 45° relationship with a further bevel gear 56 pinned to a shaft 57 having a longitudinal axis perpendicular to that of shaft 46 and journalled at opposite ends within needle bearings 59,60 and maintained longitudinally therein by respective thrust bearings 62,63. Shaft 57 integrally embodies a pinion 65 which meshes with a driven gear 66 connected as described later to a shaft 67 parallel with shaft 57 and also perpendicular to input shaft 46. Said shaft 57 is journalled at opposite ends within housing 41 by needle bearings 69,70 and is positioned longitudinally by thrust bearings 71,72. Shaft 67 carried a small diameter pinion 74 which in turn meshes with a relatively large diameter gear 75 which is carried by a shaft 76 journalled similarly longitudinally by thrust bearings 81,82.

Integrally formed upon shaft 76 is a pinion 83 which meshes with a main shaft driving gear 84 which is secured to a door driving shaft 86 by a key 87, with shaft 86 being journalled within housing 41 by needle bearings 88 at the lower ends and extending well below the floor or bottom wall 27 of housing 14 to present a toothed portion 86' for engagement with a spline (not shown) of a door actuating arm or structure or structure associated with the door for causing rotation about the hinge axis of a door. At its upper end, shaft 86 is journalled within heavy duty ball-type thrust bearings 90 mounted within a boss 91 of a horizontally disposed cover portion 92 of housing 41.

It may here be observed that pinions 65, 74 and 83 and gears 66, 75 and 84 respectively driven by these pinions are preferably of helically cut character for providing substantially noiseless meshing for quietness of operation of the operator.

The coupling of gear 66 to shaft 67 is accomplished by the provision of an over-riding or over-running clutch C whereby gear 66 is permitted to turn at greater velocity than shaft 67 or to be rotated in its normally driven direction in the absence of rotation of shaft 67 for purposes more fully set forth hereinbelow.

There is thus seen to be provided a gear train or transmission for permitting the rotary motion provided to input shaft 46 upon energization of motor M to be provided with a mechanical advantage and speed reduction for achieving an overall ratio of approximately 156:1 whereby the door driving shaft 86 wll be caused to rotate at a speed of preferably about 10 RPM at normal full speed of motor M.

An upper end portion 86″ of the main driving shaft extends upwardly beyond cover plate 92. Carried upon said portion in co-rotating relationship and clampingly secured thereto by means of a screw 94 are three cam plates 95, 96 and 97, each having lobes and dwell portions of different arcuate extents for actuating corresponding ones of three switches 99, 100 and 101 of the roller actuator type mounted upon cover plate 92. Switch 99 is adapted to be actuated upon rotation of shaft 86 by an amount sufficient to bring the door into nearly opened disposition or so-called "back check" condition and for this purpose is interconnected with control 20 for the purpose of reducing energization of motor M to retard the speed of the door as it approaches the fully opened position. Switch 100 is adapted for actuation as the door 16 reaches its nearly fully closed position, being also connected with control 20 to cause the latter to change dynamic braking of motor M as the door approaches its nearly closed position. Switch 101 is also interconnected with control 20 and is operative only in the event that the door should be moved manually open into its so-called panic position. These switches are interconnected in accordance with the functions provided by the control circuitry of said Catlett et. al. U.S. Pat. No. 4,006,392.

In accordance with the invention, door operator A is intended to provide for automatic opening of door 16 for either normal left hand swing (right hand panic) or normal right hand swing (left hand panic) or both left and right hand swing. Therefore, cam plates 95, 96 and 97 are appropriately arranged, being each provided with lobe and dwell portions which are symmetrically oriented whereby the cam plates may be dispositioned appropriately with either face up in desired arcuate relationship upon shaft 86 for actuating corresponding ones of switches 99, 100 and 101 to provide the switching function hereinabove described, no matter whether the shaft 86 is intended to be driven clockwise or counterclockwise for either direction normal door opening movement as described above.

Figure 4:
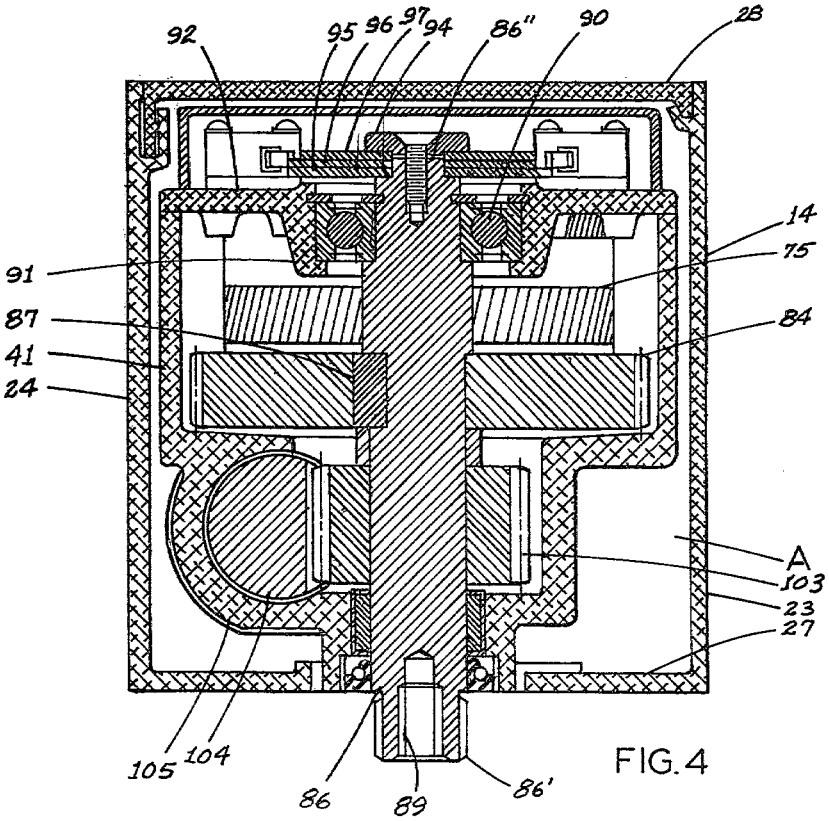
FIG. 4 is a vertical transverse sectional view taken along line 4—4 of FIG. 2.

Secured to main drive shaft 86 by means of a key 102 is a pinion 103 which meshes with a horizontal rack gear 104. Referring to FIG. 4, said rack gear 104 is of a partially circular section, being journalled slidably within an elongated portion 105 of housing 41 for slidable movement therein in corresponding directions horizontally upon rotation in either direction of pinion 103 caused by corresponding rotation of drive shaft 86. The horizontal disposition of rack gear 104 with respect to pinion 103 when the drive shaft 86 is in a position corresponding to the door being closed is demonstrated in FIG. 5, there being a space 107 for accommodating leftward movement of rack gear 104 upon counterclockwise rotation of shaft 86. Further, the left end face of rack gear 104 is provided with a threaded bore 108 for receiving a screw, as at 109 in FIGS. 8–10, for providing an adjustable stop adapted to bear against one end wall 111 of housing 105 for limiting leftward movement of rack gear 104 in the case of the embodiment depicted in FIGS. 8–10, being unnecessary in the embodiments of FIGS. 5–7 not used in the embodiments of FIGS. 11–13.

Figure 5:
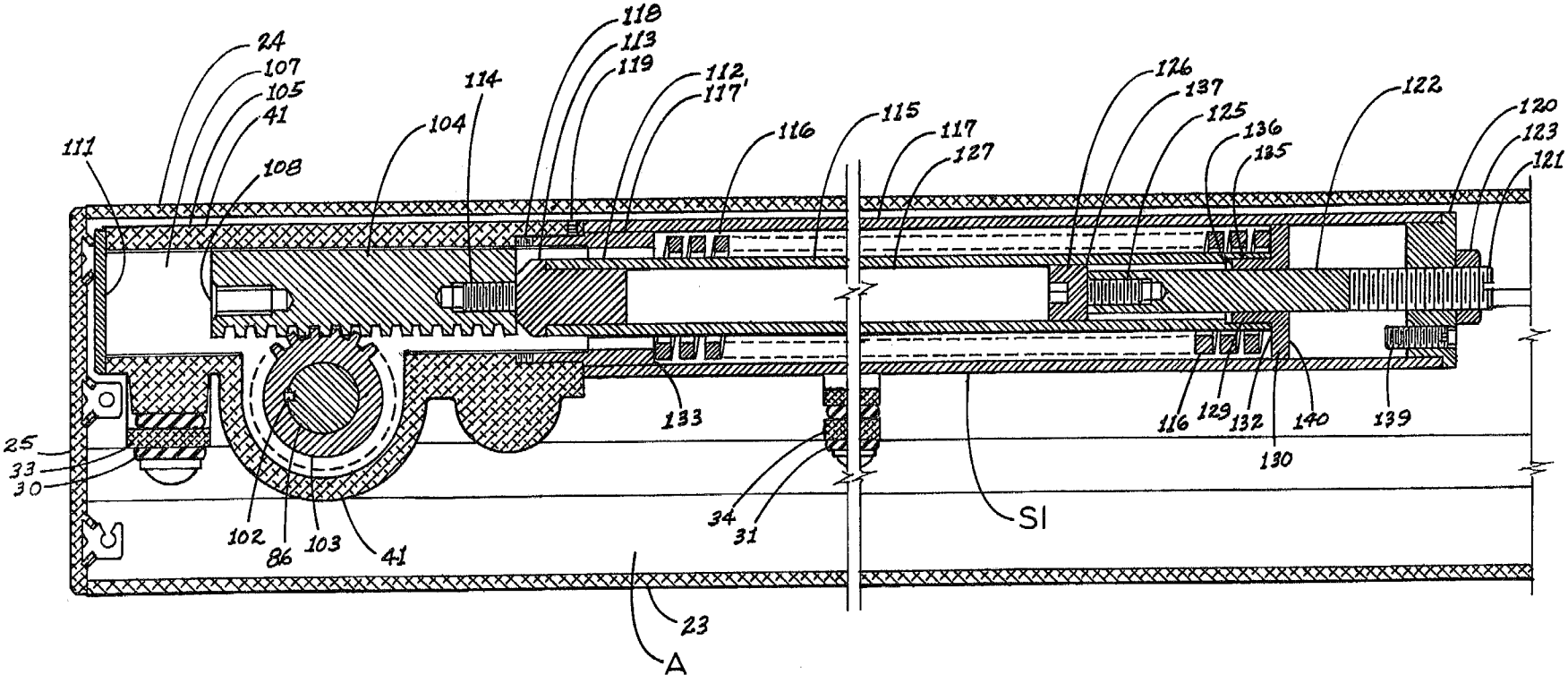
FIGS. 5–7 are each horizontal longitudinal sectional views of an embodiment of the door operator, taken generally along line 5—5 of FIG. 3, configured for normal left hand swing opening of the door.
Figure 6:
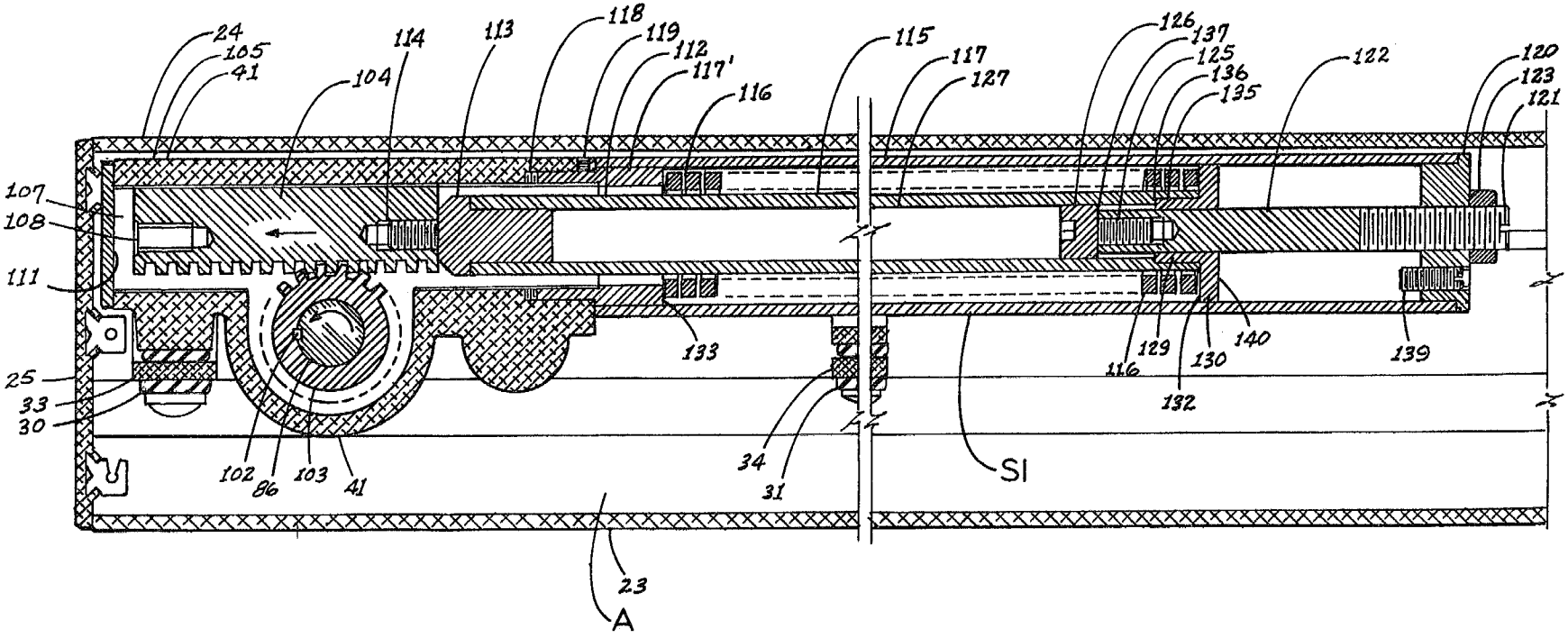
Figure 7:
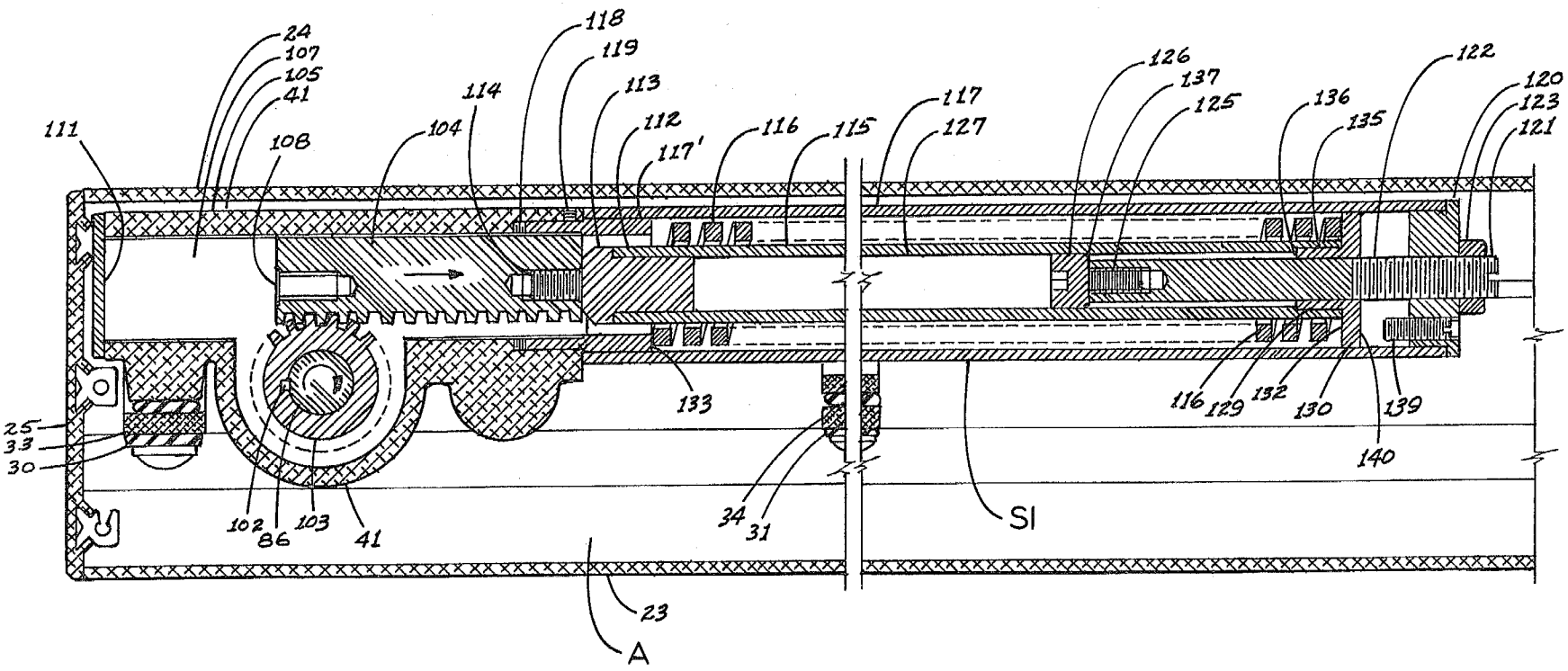

Interconnected with the rack gear 104 is a spring assembly of replaceable, modular character configured for receiving energy from the rack gear upon shifting thereof by driving of motor M in accordance with a preselected direction of normal door opening movement, and for thereafter transferring the received energy to the rack gear for the purpose of closing the door without requiring motor M to be energizing. In FIGS. 5–7, the spring module is designated S1, in FIGS. 8–10, S2, and in FIGS. 11–13, S3. Hence, the three different spring modules S1, S2, and S3 appear to provide in effect three different operator embodiments, yet the embodiments are but variations of a single operator A of the invention which thus takes on a universal, interchangeable character.

Figure 8:
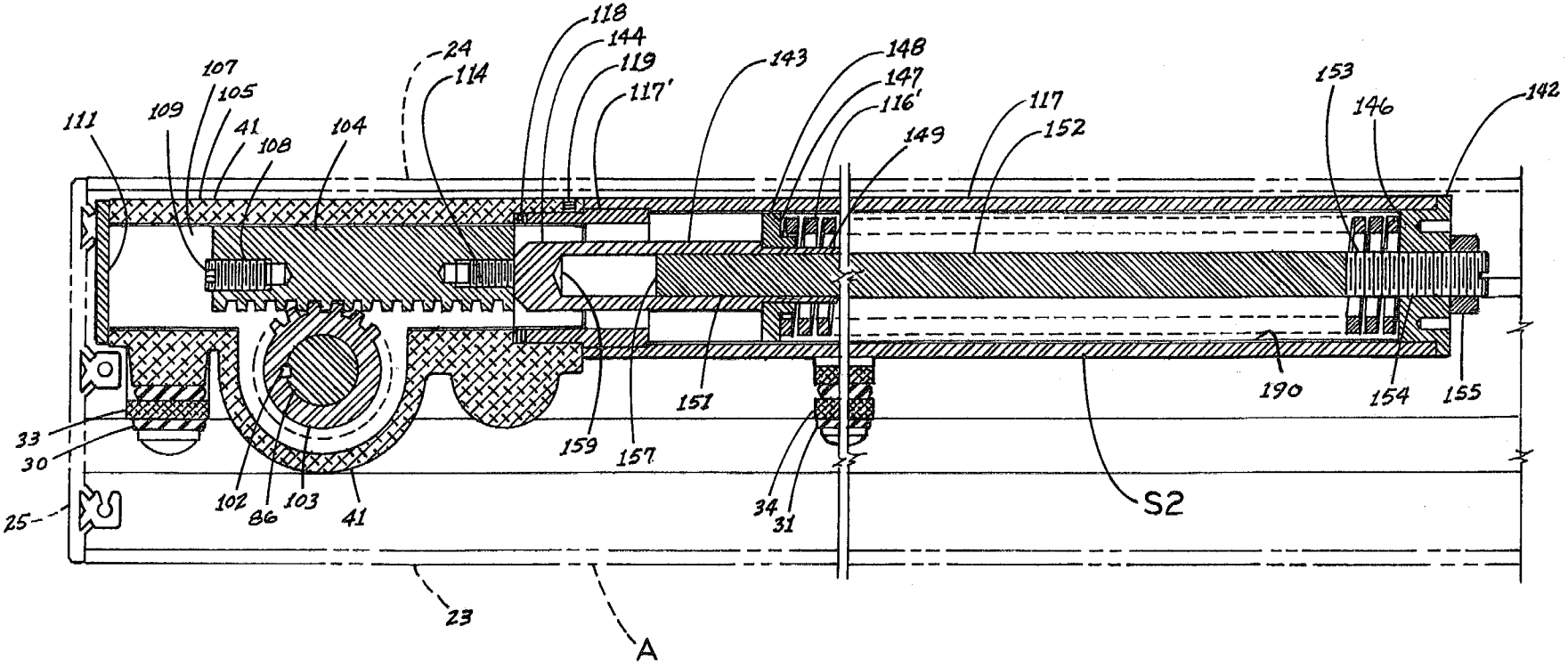
FIGS. 8–10 are each horizontal longitudinal sectional views taken similarly along line 5—5 of FIG. 3, of an embodiment of the door operator configured for normal right hand swing opening of a door.
Figure 10:
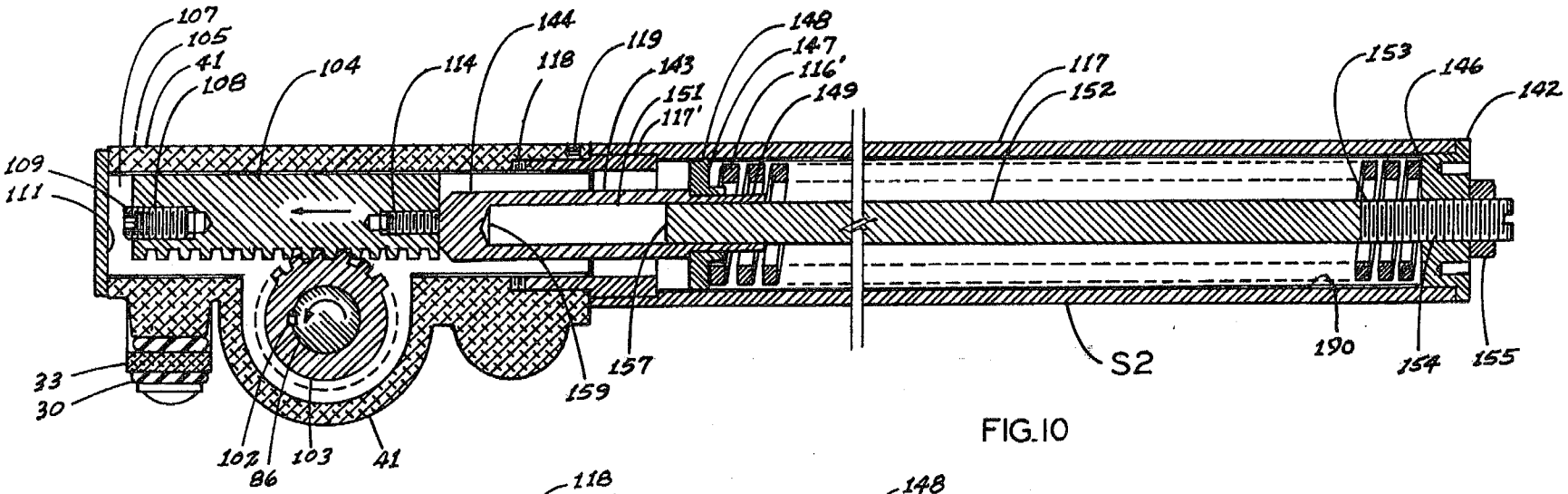
Figure 9:
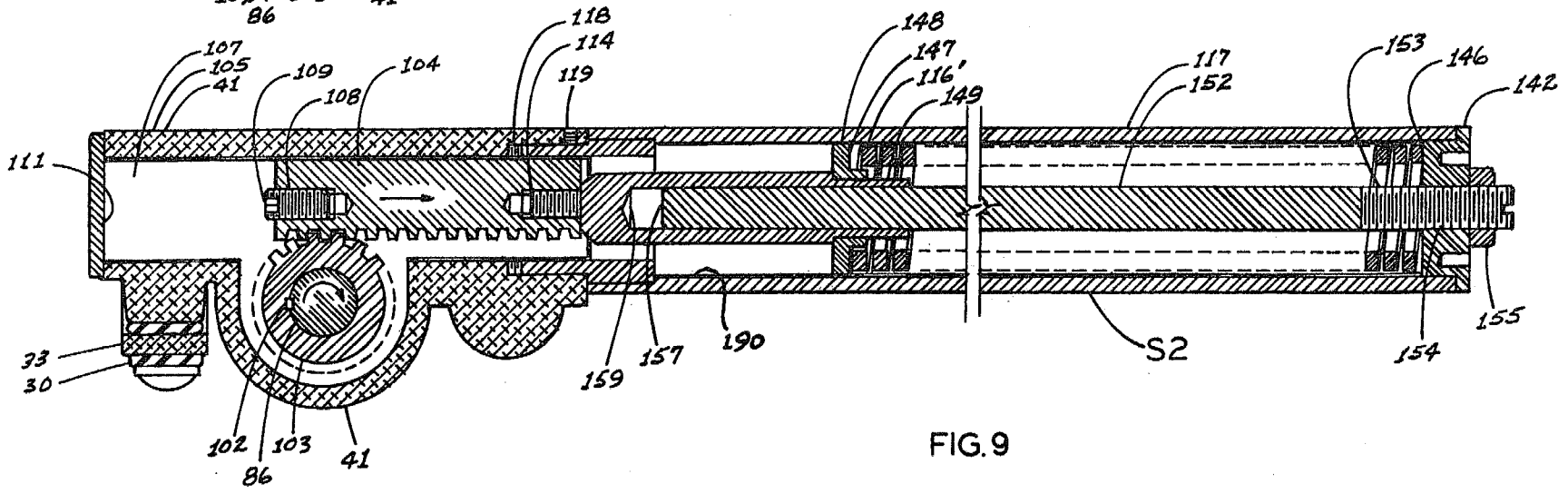
Figure 11:
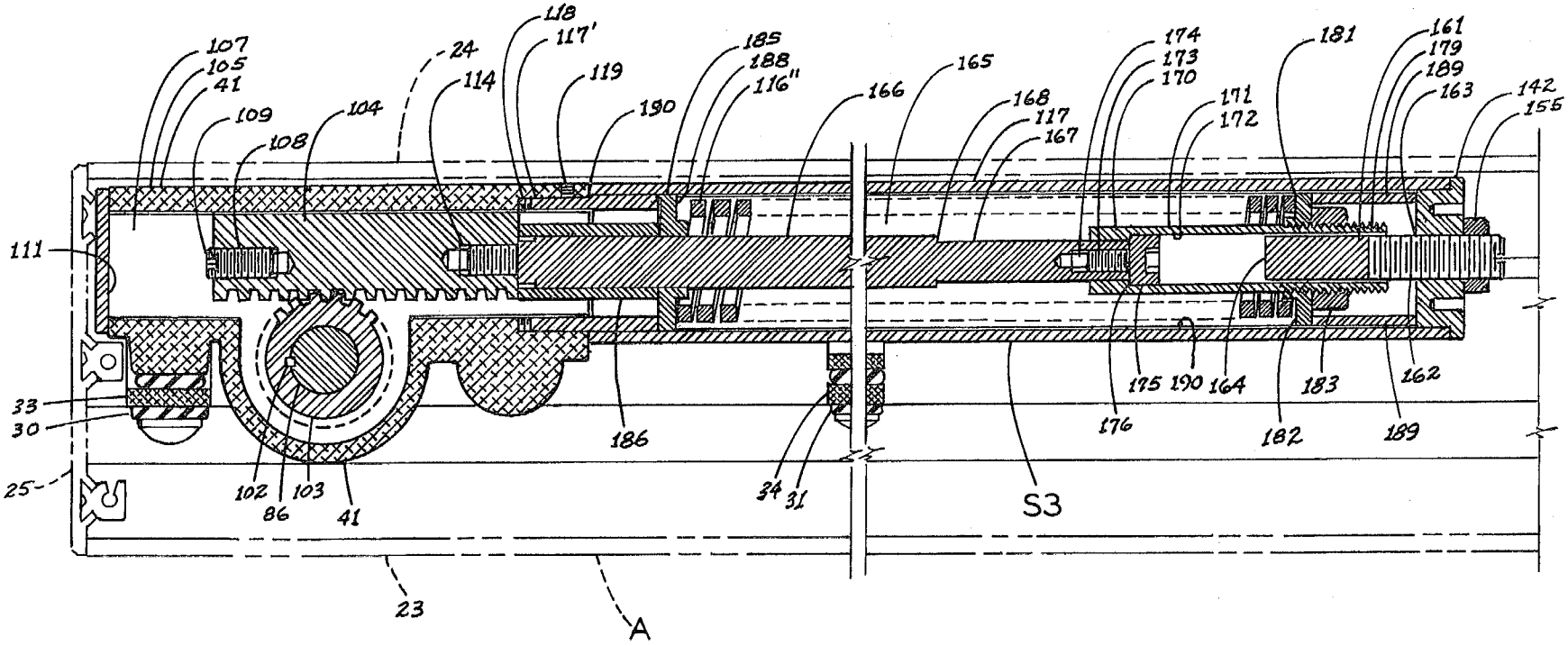
FIGS. 11–13 are similarly horizontal longitudinal sectional views, again taken generally along line 5—5 of FIG. 3, and illustrating the door operator configured for both right hand and left hand normal swing opening of the door.
Figure 12:
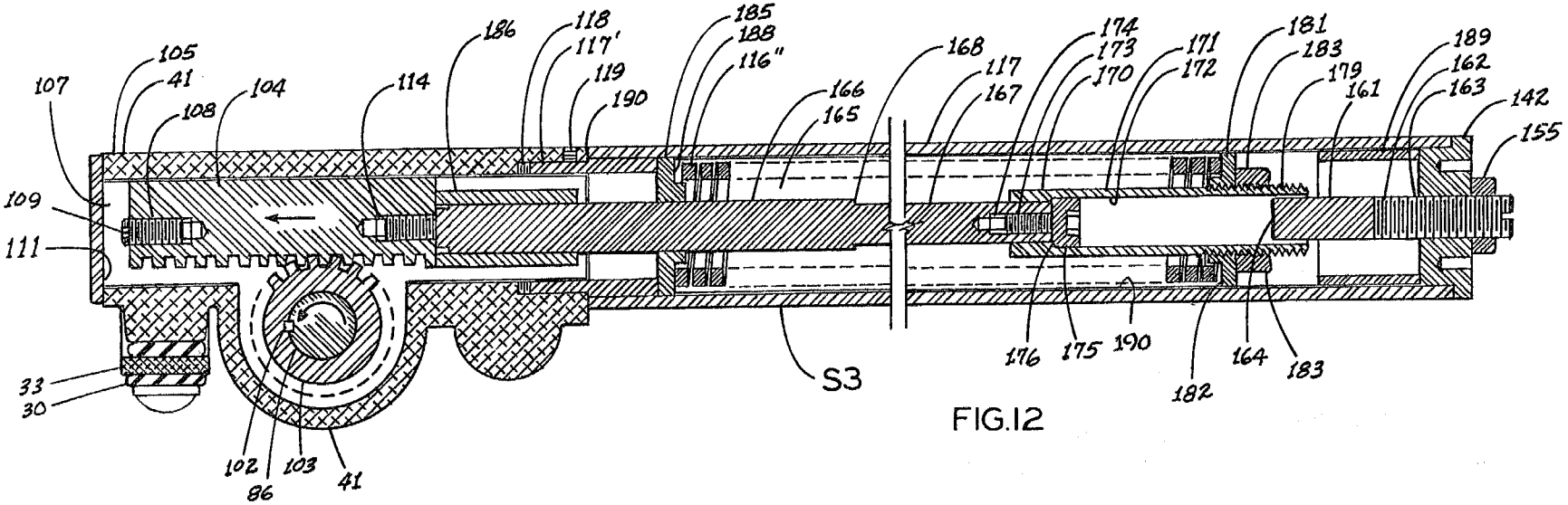
Figure 13:
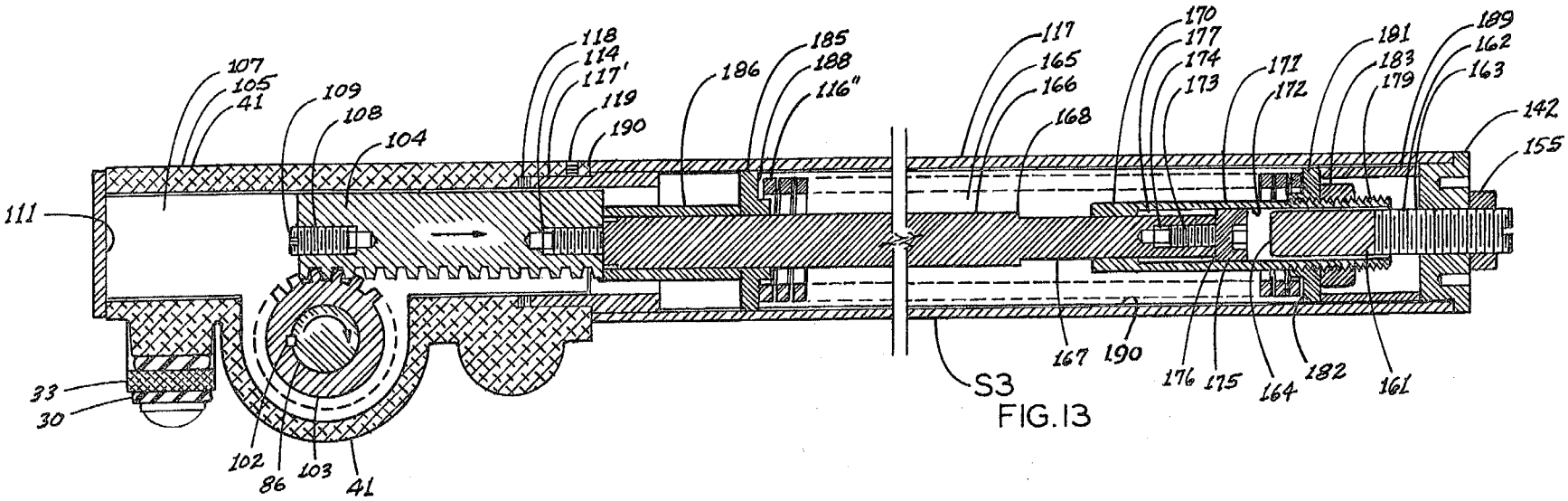

The operator configuration of FIGS. 5–7 provides automatic operation of a door intended for normal left hand swing opening (right hand panic opening). The configuration of FIGS. 8–10 provides operation of a door intended for normal right hand swing opening (left hand panic opening). And the configuration of FIGS. 11–13 provides automatic operation for both left and right hand normal opening (and with respectively right and left panic opening).

Referring to FIGS. 5–7, operator A is provided with a spring module or assembly S1 which as a matter of generality includes a push rod 112 including a threaded end fitting 113 threaded into a bore 114 in the right end face of rack gear 104. The push rod has a tubular portion 115 extending into the center of a coiled compression spring 116 in coaxial relationship therewith over a major portion of the length of the spring being interconnected as later described with the end of the spring remote from rack gear 104.

Spring 116 is maintained in a compressed pretensioned or preloaded state within a cylindrical housing 117 which includes a threaded sleeve portion 117′ which is threaded into a corresponding bore 118 of rack housing 105 and secured therein by means of a set screw 119. Housing 117 is closed at its rack remote end by a plug 120 into which is threaded a portion 121 of a rod-like extension 122 which extends adjustably inwardly of the housing 116, said threaded portion 121 having a lock nut 123 thereon for maintaining rod 122 in preselected, fixed longitudinal relationship within housing 116. The inner end of rod 122 has a threaded bore 125 in which is fitted a screw 126, the head of which extends into the bore 127 of a tubular push rod extension 115 whereby the latter is slidably disposed upon extension 122 and screw 126.

Secured to the rack remote end of push rod tubular extension 115 is a sleeve-like fitting 129 having a flange 130 of diameter nearly as great as the inner diameter of housing 116 for permitting slidable movement therein while presenting a shoulder 132 for bearing against one end of spring 115 to maintain the same in a compressed, pretensioned state such as preferably to about 450–465 pounds, with the other end of the spring bearing against a corresponding shoulder 133 of collar 117. Fitting 129 is secured to tubular push rod portion 115, as by being threaded within a bore 135 thereof but dimensioned to present a shoulder 136 adapted to bear against a corresponding shoulder 137 defined by the head of screw 126.

The latter constitutes an adjustment screw which may be screwed in or out of bore 125 whereby a predetermined incremental distance is provided between shoulders 136,137 to define the distance over which push rod 118 and its tubular portion 127 may be shifted to the left upon movement of rack gear 124 produced by rotation of drive shaft 86, as demonstrated in FIG. 6. Plug 120 is also provided with an adjustment screw 139 adjustably disposed within a bore of plug 120 to define a distance of movement between said the head of screw 139 and a corresponding rear face 140 of the flange 130 to define the distance over which rack gear 104 may be shifted to the right upon rotation of shaft 86. In this way, the arcuate extent of movement of the door in either direction from its closed position are defined and may be conveniently and precisely selected as desired for a given door. Further, such adjustments are intrinsically characteristic of spring module or means S1, whereby operator A when utilizing such module will have been configured not only for proper door opening but also for defining the limits of door movement.

Normal door opening operation by operator A when employing module S1 is shown in FIG. 6. Upon energization of Motor M by controller 20, the gear train causes rotation of door driving shaft 86 in a counterclockwise direction to cause the door to swing normally open in response to the power delivered to it by shaft 86. At the same time, rack gear 104 shifts longitudinally to the left, causing tubular push rod portion 115 to increasingly tension spring 116 whereby kinetic energy becomes stored in the spring as potential energy. Such leftward shifting continues until face 136 of fitting 129 engages the head shoulder 137 of screw 126, the position of which has been selected by the extent to which rod 122 is threaded into plug 120 and there locked by nut 123. At such engagements, shifting of rack gear 104 is stopped to define the angular extent through which the door has been permitted to swing. As said door approaches its thus deprived fully open position, switch 99, interconnected with control 20, is actuated by causing the control to reduce the energization of motor M and thus reduce its speed whereby the door speed is retarded.

At the termination of the open delay interval established by control 20, motor M is deenergized and switched into a dynamic braking mode, as is known in the motor control art.

The energy stored in spring 116 is now returned to rack gear 104 for rotating door driving shaft 86 in a direction for closing of the door. Such rotation is coupled through the gear train to motor M which is no longer energized. However, the driven motor armature produces a current which is limited by controller 20 to provide dynamic braking by the motor for limiting the speed of door closing. Even in the event of the failure of electrical power, the door thus closes in response to the energy stored in spring 116. As the door approaches its nearly fully closed position, switch 100 is actuated to retard the speed of the door by increasing the dynamic braking of motor M and the door shuts gently with the spring module and rack gear components being again as depicted in FIG. 5.

If the door should be manually pushed open in its normal moving direction as at a greater speed than it is being driven open (about 10 rpm), over-running clutch C allows normal free opening movement of the door against the tension of spring 116, even though motor M continues to operate normally.

If, while closed, there should be an emergency or panic situation, it is conceivable that an attempt could be made to manually force open the door in the direction opposite from its normal swing. In accordance with the invention, such so-called panic movement is made possible by the new operator so that there will be no unsafe situation resulting from an inability to swing the door opposite from its normal direction, as where the door normally swings inward, i.e., into a room, store, or public place, etc., yet where persons within such location might, in the event of emergency or in panic, attempt to force the door outward.

FIG. 7 illustrates such operation wherein the reverse swinging of a normal left swing door causes clockwise rotation of door driving shaft 86 for right longitudinal shifting of rack gear. Push rod 113 and its tubular portion are thus also shifted to the right, until face 140 of flange 130 contacts adjustable stop screw 139, limiting further movement and thus defining the panic swing arcuate limit of the door. At the same time, panic movement of shaft 86 causes operation of switch 101 which causes electrical power to be switched to preclude normal driving of motor M, control 20 and switch 101 being preferably so wired such that when switch 101 is actuated, the provision of power to motor M is prevented.

FIGS. 8–10 show a version of operator A configured, by the provision of a modified spring module S2, for automatically actuating a door mounted for normal right hand swinging (left hand panic). Within tubular housing 117, which is closed by a modified plug 142, there is provided a relatively short tubular push rod 143 having a terminal portion 144 threaded into bore 114 within rack gear 104. A spring 116' of the same character as spring 116 (FIGS. 5–7) is maintained in precompressed, pretensioned state, e.g., to about 450–465 pounds, by bearing at one end against a face 146 and at the other end against a face 147 of a flange 148 which is seated upon a reduced diameter portion 149 of push rod 143.

Housing 117 is secured as in the embodiment of FIGS. 5–7 so as to be quickly detachable from the rack gear housing 105 for replacement of module S2.

Extending into a bore 151 of push rod 143 is a rod 152 having one end 153 threaded into a correspondingly tapped bore 154 of plug 142 and maintained in position by a locknut 155. The other end 157 of rod 152 which is received in this bore 151 in relative slidable relationship thereto, is thus selectively positionable with respect to a face 159 at the end of bore 151 whereby push rod 143 is free to move with rack gear 104 to the right as shown in FIG. 9, upon door opening movement, being driven by motor M until face 159 engages rod end 157. Thus, rod 152 serves as an adjustable stop for limiting opening of the door.

As in the previous embodiment, energy normal during door opening is transferred to spring 116' as it is further compressed, as shown in FIG. 9 until the door reaches its fully open position, limited as above described. Energization of motor M is then discontinued, rack gear 104 is then driven to the left causing the door to be driven to its closed position by rotation of door driving shaft 86. Switches 99 and 100 operate as before.

In an emergency panic situation, operation of the door operator with spring module S2 is shown in FIG. 10, wherein left hand swinging of the door in the panic direction causes counterclockwise rotation of shaft 86, actuating switch 101 which controls the provision of power to motor M for interrupting or preventing its normal driving energization.

It is observed that bore 108 at the left end of rack gear 104 is provided with screw 109 to serve as an adjustable stop by engagement of enclosure face 111, thus limiting the extent to which the door can be swung open in the panic direction.

In all of the embodiments of door operator A, it is preferred that the gear ratio between pinion 103 and rack gear 104 be such that approximately 1.5 inches (38.1 centimeters) of shifting of the rack gear will result from 90° of rotation of door driving shaft 86.

Referring now to FIGS. 11–13 there is illustrated a door operator of the invention as incorporating yet another spring module S3, the operator being suited for providing both left and right hand normal opening, yet permitting respective right and left hand panic opening.

As shown in FIG. 10, spring module S3 includes the same tubular housing 117 secured to rack gear housing or enclosure 105 by a sleeve portion 117' having an end threaded into bore 118 of enclosure 105 and locked therein by set screw 119. The rack gear remote end of housing 117 is enclosed by previously described plug 120', there being a short rod or stop 161 disposed therein by threading of one end 162 into a tapped bore 163 of the plug and maintained in preselected horizontal relationship by locknut 153, the other end providing a face 164 for engagement as later explained.

Threaded into bore 114 rack gear 104 is a push rod 165 having a cylindrical portion 166, having a first diameter, and a reduced diameter remote portion 167 so as to define a shoulder 168. Slidably engaged upon the cylindrical portion 167 of the push rod is the sleeve portion 170 of a tubular member 171 having a bore 172 of diameter slightly greater than rod portion 167. Stop 161 extends into bore 172. A screw 173 is threaded into a bore 174 at the end of push rod portion 167 to serve as an adjustable stop, having a head 175 of diameter greater than push rod portion 167 to provide a shoulder 176 for engagement of a corresponding shoulder 177 (see FIG. 13) defined by sleeve 170.

A threaded outer portion 179 of sleeve 171 has fitted on it a flanged collar 181 to provide a peripheral seat 182 for spring 116'', said collar being maintained in place relative to tubular member 171 by a locknut 183. A spacer sleeve 189 spacedly locates flanged collar 181 a preselected distance from plug 120'. The opposite end of spring 116' is seated against a similar flanged collar 185 which is spaced upon push rod portion 166 from rack gear 104 by a tubular sleeve 186. Collar 186 provides another seat 188 for the opposite end of spring 116'' whereby it is compressed between flanged collars 181 and 186 in a pretensioned state, as in previous embodiments. Collar 181 and 183 are positionable upon tubular members 171 to achieve a preselected tension (i.e., preferably 450–465 pounds) within spring 116''.

Referring now to FIG. 12, operation of this embodiment is illustrated for normal left hand opening of door 16 when driven by motor M. Counterclockwise rotation of door driving shaft 86 causes shifting to the left of rack gear 104. This causes pushrod 165 to cause shifting to the left of tubular member 171 by engagement of sleeve 170 with screw head 175, causing flanged collar 181 to be also drawn to the left, further compressing spring 116'. In this way, energy supplied by motor M in driving door 16 to an open position is transferred to spring 116''. The door continues to open until adjustable stop screw 109 at the left end of rack gear 104 contacts housing face 111, thus depriving a fully open position of the door.

Upon deenergization of motor M, spring 116'' returns its stored energy to rack gear 104 via push rod 165, causing shaft 86 to be driven clockwise and with the transmission causing rotation of motor M, now acting in its dynamic braking mode to provide controlled closing of door 16.

It is a matter of importance to observe that spring module S3 is designed to very precisely maintain door 116 in its closed position with precise tolerance in contrast with the usual backlash or play which otherwise is quite typically present in prior art door operators. For this purpose, the play is eliminated by precise adjustment of the location of housing 117 with respect to rack gear housing 105, such being achieved by loosening of set or lock screw 119 and then rotating housing 117 within the threaded bore 118 to cause shifting of housing 117 in or out of bore 118. Preferably, the length of the various elements of spring module S3 are dimensioned to provide for essentially zero play in the mechanism when there is present a slight gap 190 between spring housing 117 and gear housing 105, being approximately 0.04 inches (about 1 millimeter) whereby sufficient latitude is provided for very fine adjustment and zero positioning of the door, bearing in mind that 0.025 inches (0.64 millimeter) of play in adjustment in the rack gear mechanism may typically translate into about 2 inches (5.1 centimeters) of play at the outer end of door 16, so that such adjustment is quite accurate and precise.

When motor M is energized with reverse polarity for automatically driving door 16 open for normal right hand swing, door driving shaft 86 is caused to rotate clockwise, shifting rack gear 104 and push rod 165 to the right, as depicted in FIG. 13. Space 186 causes flanged collar 185 to shift to the right, but spacer 189 prevents rightward shifting of flanged collar 181 whereby spring 116'' is caused to be further compressed, thus receiving energy from motor M as the door is driven open by further rotation of shaft 86. Also, flanged collar 181 prevents rightward shifting of tubular member 171 whereby reduced diameter portion 167 of the push rod is caused to slide relative to sleeve 170, and with movement continuing until screw head 175 contacts the end surface 164 of rod 161, thereby preventing further movement of the rack gear and limiting the arcuate extent of door opening.

Of course, when motor M is then deenergized, the energy stored in spring 116'' causes leftward shifting of rack gear 104 for driving door 16 to its closed position but with motor M being in a driver mode and providing dynamic braking for controlled door closure.

During the normal actuation of the door in this manner switches 99 and 100 are actuated by the embodiment of FIGS. 11–13, and as described previously for reducing the speed by the door as noted. Panic operation of the door is also permitted by this embodiment, as will be apparent from FIG. 12, wherein the relationship of the parts during normal left swing corresponds to right hand panic swing of the door, and from FIG. 13, wherein normal right hand swing corresponds to left hand panic swing. Switch 101 is wired to control 20 in this embodiment to reverse the polarity of connected of motor M so that spring 116″ is under proper control when the door closes after opening in a panic direction.

Because of the transmission arrangements of level gears and needle bearings operation of the new operator is quiet and smooth and provides reliable and fully safe operation of the door in both normal and panic modes. The virtually noiseless operation of the operator is further ensured by the use, if desired, of a liner within the spring housing 117, as shown at 190 in various embodiments.

Such liner 190 may be one of various synthetic resin materials, thermoplastics, etc., to provide a thin, low friction surface against which the spring 116, 116′, 116″ of any of the various spring modules S1, S2, S3 may bear in slidable relationship without metal-to-metal contact, in being preferred that such liner merely extend along substantially the entire inner surface of housing 117, providing thus no interference with the mechanical components therein.

Although the foregoing includes a description of the best mode contemplated for the invention, it should be understood that changes and modifications in the formation, construction, and arrangement and combination of the several parts of the new automatic door operator embodiments may be made and substituted from those herein shown and described without departing from the nature and principle of the invention.

What is claimed and desired to be secured by Letters Patent is:

1. A universally configurable door operator for driving any of various swing-mounted doors regardless of the directions of normal opening and panic swing of such door, said operator including a prime mover and a main housing and comprising within said main housing a door driving shaft, means mounting said door driving shaft for rotation about a vertical axis, said shaft being connectable to said door for closing and opening of said door by either clockwise or counterclockwise rotation of said door driving shaft, transmission means interconnecting said prime mover and said door driving shaft for producing rotation of said shaft in either a clockwise or counterclockwise direction for normal opening of said door pursuant to selective delivery of power by said prime mover, a pinion interconnected with said shaft for corresponding rotation with said shaft, and a rack gear meshing with said pinion for shifting movement in either of opposite directions about a longitudinal axis transverse to the rotational axis of said shaft in response to clockwise or counterclockwise rotation of said shaft, said main housing including an opening for access to one end of said rack gear, the improvement comprising a single changeable modular assembly including an assembly housing for selective attachment to said main housing and an operating rod within said assembly housing and including a portion extending through said opening into said main housing for selective interengagement with said one end of said rack gear, said assembly housing including a single coiled compression spring maintained therein in a state of pretension by said operating rod, said assembly housing orienting said spring for compression on an axis aligned with the longitudinal axis of transverse shifting movement of said rack gear, said spring having an inner end oriented toward said rack gear and an outer end oriented remote from said rack gear, said operating rod providing further tensioning of said spring by compression of said spring from said inner end or the outer end thereof in response to shifting of said rack gear in a predetermined direction corresponding to the direction of normal opening swing of said door for storing energy, said spring returning to its original state of pretension for transferring said stored energy to said rack gear via said operating rod to close said door upon cessation of delivery of power by said prime mover, and means within said assembly housing for limiting movement of said operating rod to establish the permissible extremes of shifting of said rack gear thereby to determine the permissible extremes of normal opening and panic swing of said door, said modular assembly being changeable for changing the normal opening and panic swing directions of said door.

2. In a door operator according to claim 1, said motor being of a permanent magnet rotary type which is adapted for being controllably energized for driving at a preselected speed, said transmission including a speed reduction gear train interconnecting said motor and door driving shaft, the improvement further comprising motor control means adapted for controllably energizing said motor for driving said gear train at a preselected speed to control the speed of normal door opening and said motor being adapted for being driven when not energized by said gear train for providing an output current to be controllably modified by said control means for controlling the speed of said motor and, accordingly, the speed of door closing.

3. In a door operator according to claim 1, the improvement further comprising switch means for controlling the speed of said motor dependent upon the position of said door relative to its closed position and cam means carried by said shaft having lobe and dwell portions symmetrically oriented with respect to a central axis of said main housing aligned with the closed position of said door for providing operation of said switch means regardless of whether said shaft is driven clockwise or counterclockwise for normal door opening direction of movement.

4. In a door operator according to claim 3, the improvement further comprising first and second switch means each interconnected with said control means and presented for being actuated by rotation of said door driving shaft to retard the speed of said motor as said door approaches respective nearly open and nearly closed positions, and third switch means interconnected with said control means and mounted for being actuated by rotation of said door driving shaft in response to emergency opening movement of said door for de-energizing said motor.

5. In a door operator according to claim 3, the improvement further comprising cam means comprising three cam plates situated one atop the other and carried at the upper end of said shaft in selectively dispositional relationship upon said shaft for actuating said switch means, said switch means having followers engaging said cam plates for actuation thereof.

6. In a door operator according to claim 1, the improvement further comprising said assembly housing being of cylindrical configuration and of constant inside diameter, and a liner within the interior of said assembly housing for lining the interior surface thereof, said spring being located within said liner, said liner being of thin, low friction synthetic resin material to provide a low friction surface against which said spring may bear in slidable relationship without metal-to-metal contact for virtually noiseless operation.

7. In a door operator according to claim 1, the improvement further characterized by normal opening movement of said door, when left-handed, being effected by counterclockwise rotation of said shaft with compressing of said spring from the outer end thereof by said operating rod and, when right-handed, being effected by clockwise rotation of said shaft with compressing of said spring from the inner end thereof by said operating rod.

8. In a door operator according to claim 7, said door having both left-handed and right-handed directions of normal opening with corresponding counterclockwise and clockwise rotation of said shaft, and means slidably engaging the rack gear-remote end of said operating shaft for effecting compressing of said spring by the outer end thereof upon counterclockwise rotation of said shaft for normal left-handed door opening movement but permitting the outer end of said spring to remain fixed upon normal right-handed door opening movement, and means slidably engaging the rack gear-proximate end of said operating shaft for effecting compression of said spring by the inner end thereof upon clockwise rotation of said shaft for normal right-handed door opening movement.

* * * * *